United States Patent [19]

May

[11] 4,343,592

[45] Aug. 10, 1982

[54] STATIC SHROUD FOR A ROTOR

[75] Inventor: Gordon C. May, Allestree Park, England

[73] Assignee: Rolls-Royce Limited, London, England

[21] Appl. No.: 147,269

[22] Filed: May 5, 1980

[30] Foreign Application Priority Data

Jun. 6, 1979 [GB] United Kingdom ..... 7919728

[51] Int. Cl.[3] ..... F01D 11/08

[52] U.S. Cl. ..... 415/171; 415/127; 415/14

[58] Field of Search ..... 415/14, 171, 127

[56] References Cited

U.S. PATENT DOCUMENTS

| | | | |
|---|---|---|---|
| 2,684,568 | 7/1954 | Senger | 415/14 |
| 3,039,737 | 6/1962 | Kolthoff | 415/171 X |
| 3,085,398 | 4/1963 | Ingleson | 415/127 X |
| 3,227,418 | 1/1966 | West | 415/127 |
| 3,503,616 | 3/1970 | Hickey | 415/171 X |
| 3,520,635 | 7/1970 | Killmann et al. | 415/171 X |
| 4,131,388 | 12/1978 | Brodell | 415/171 X |
| 4,149,826 | 4/1979 | Torstenfelt | 415/127 |
| 4,222,708 | 9/1980 | Davison | 415/127 |

FOREIGN PATENT DOCUMENTS

| | | | |
|---|---|---|---|
| 227536 | 3/1959 | Australia | 415/171 |
| 1291560 | 3/1969 | Fed. Rep. of Germany | 415/171 |
| 1426818 | 3/1969 | Fed. Rep. of Germany | 415/171 |
| 1426819 | 3/1969 | Fed. Rep. of Germany | 415/171 |
| 2024336 | 1/1980 | United Kingdom | 415/171 |
| 2042646 | 9/1980 | United Kingdom | 415/171 |

OTHER PUBLICATIONS

U.S. Published Patent Application, B 471,735, Feb. 3, 1976, Jaegtnes.

*Primary Examiner*—Everette A. Powell, Jr.

*Attorney, Agent, or Firm*—Cushman, Darby & Cushman

[57] ABSTRACT

A static shroud for a rotor comprises a shroud ring having a frustoconical inner surface adapted to co-operate with a peripheral portion of the rotor to define a small clearance therebetween. A plurality of actuators are provided to move the ring axially to vary the clearance in a predetermined manner. In order to compensate for eccentricity, the actuators are adapted to tilt the ring out of a radial plane when required.

13 Claims, 6 Drawing Figures

STATIC SHROUD FOR A ROTOR

Figure 1:
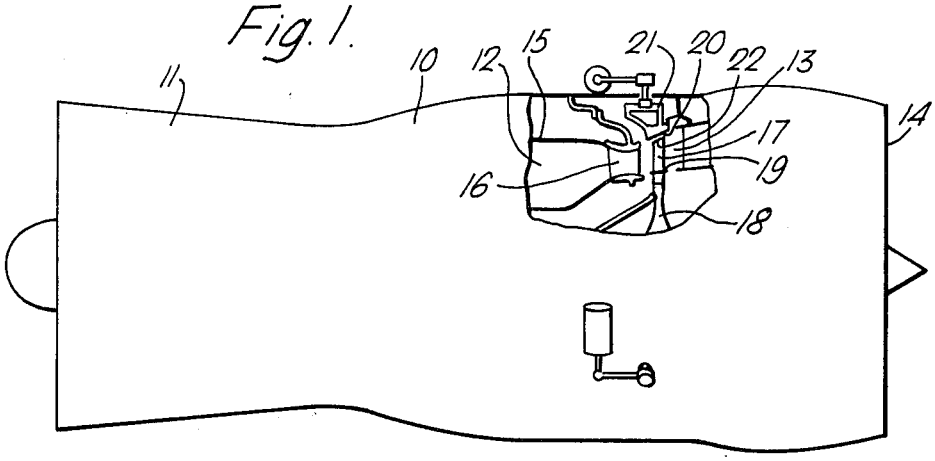

This invention relates to a static shroud for a rotor and is particularly but not exclusively concerned with a shroud for the rotor of a gas turbine engine.

In gas turbine engines as temperatures and pressures have increased and designers have been seeking to obtain the greatest possible fuel efficiency it has become increasingly clear that considerable losses may be caused by incorrect values of the clearance between the rotors of the engine and the associated static shroud structure. This is particularly the case in the turbine region where the higher speeds and temperatures involved lead to considerable thermal and centrifugal loads of the rotor and therefore require some form of matching of the expansion of the static shroud in order to avoid unacceptably large clearances.

One possible solution to these problems lies in making the static shroud structure with a frustoconical inner surface which co-operates with the periphery of the rotor to leave a small clearance and thus to effect the seal. By moving the ring axially it is then possible to vary this clearance in a pre-determined manner or to maintain it at a set value. Such constructions are described in copending application of the common assignee, Rolls-Royce Limited, namely, U.S. application Ser. No. 115,555 of Rowan Herbert Colley, filed Jan. 21, 1980.

These constructions may be very satisfactory if the casing of the engine and the rotor stay concentric so that any variation in the clearance is the same over the whole periphery of the ring. However, it is an unfortunate fact that under some conditions casings can depart from a true circular section. In this case the prior art constructions may give satisfactorily clearance over part of the periphery but there will be areas where the clearance is either too tight or too large.

The present invention provides a construction in which compensation may be made for at least large scale variations in the clearance around the periphery.

According to the present invention a static shroud for a rotor comprises a shroud ring having a frustoconical inner surface adapted to co-operate with a peripheral portion of said rotor to define a small clearance therebetween and a plurality of actuators adapted to move the ring axially to vary said clearance in a pre-determined manner said actuators being adapted to tilt the ring when necessary so as to compensate for eccentricity between said rotor and said ring.

In a preferred embodiment there are a plurality of independently operating actuators each of which acts directly on a portion of the ring and each of which is controlled in response to a value of said clearance measured at or adjacent that part of the ring moved by the respective actuator. Thus there may be a sensor which measures said clearance at or adjacent each of the positions on the ring operated upon by one of said actuators.

The optimum arrangement is one in which there are three said actuators and a preferred way of moving the ring is by way of eccentrics operated through a lever system by rams.

The ring may be allowed to float under the influence of the actuators or alternatively it may be mounted on a gimbal arrangement so that it may be constrained to pivot about a fixed centre.

Figure 3:
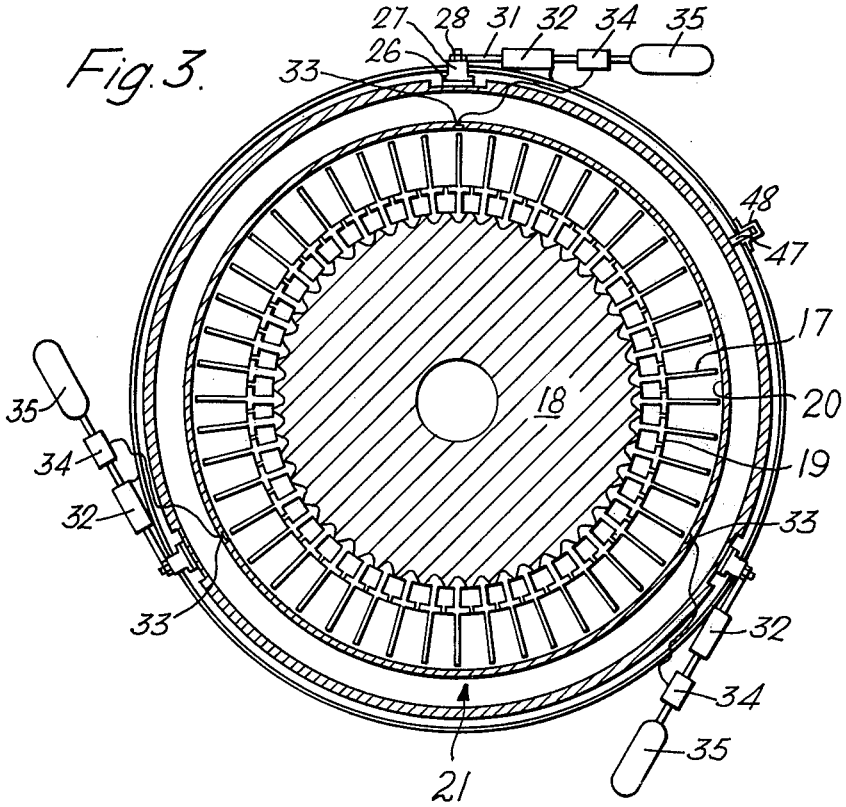
Figure 2:
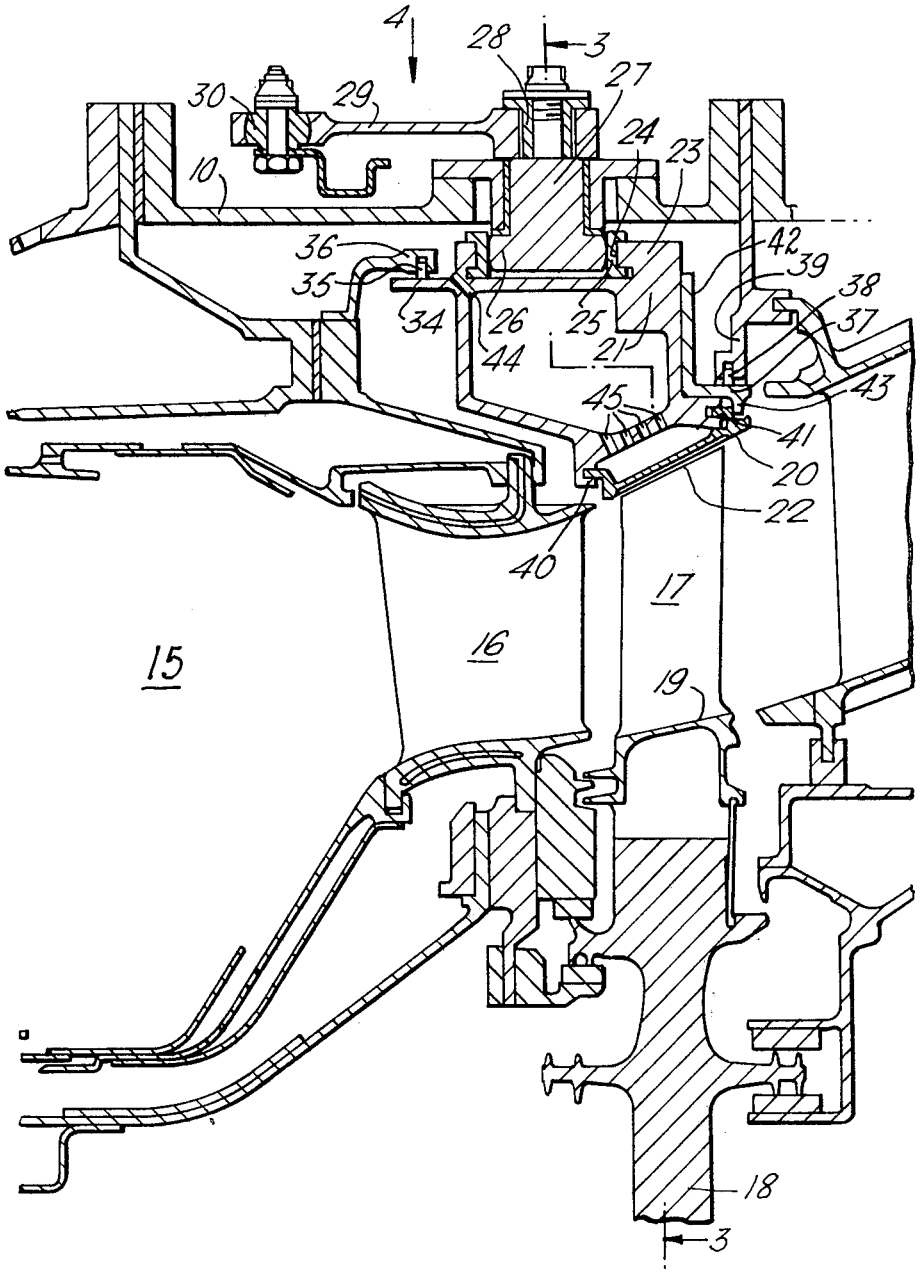
Figure 4:
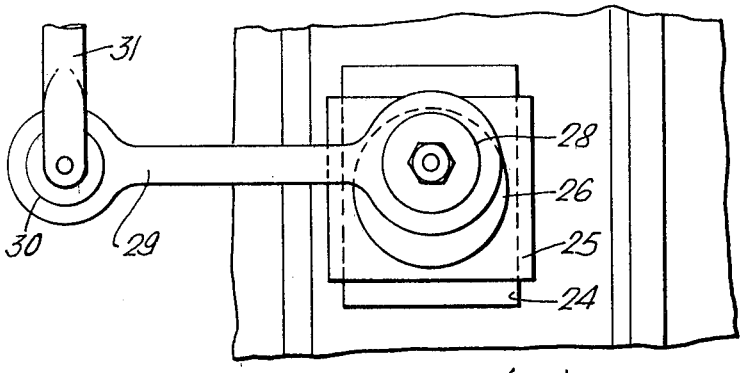
Figure 5:
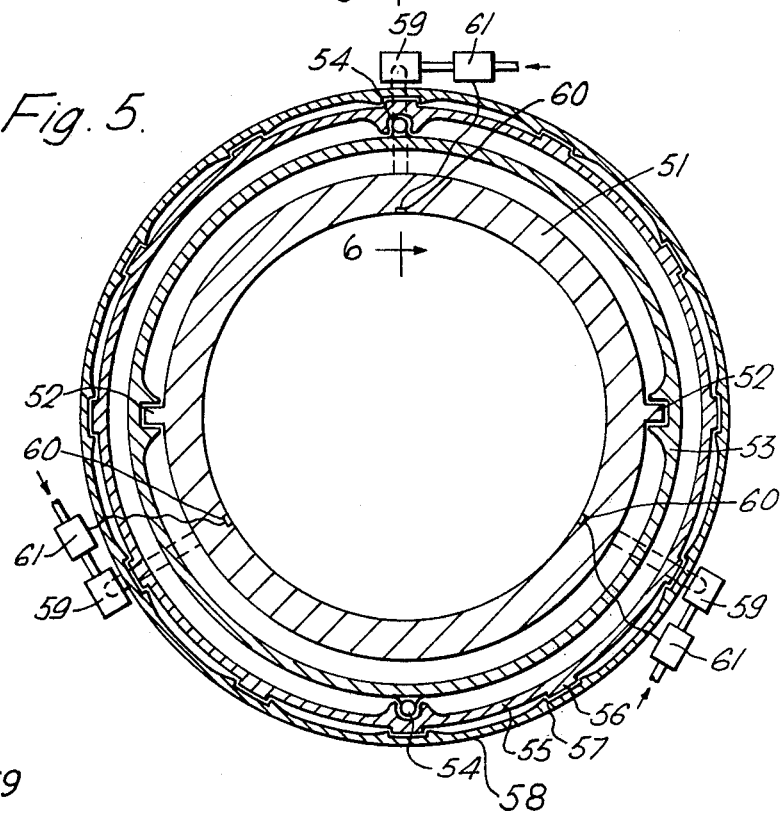
Figure 6:
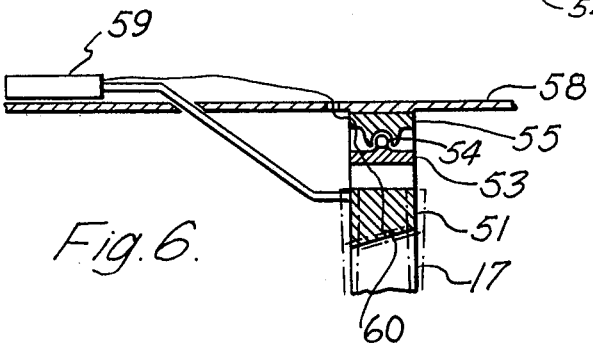

The invention will now be particularly described merely by way of example with reference to the accompanying drawings in which;

FIG. 1 is a partly broken away elevation of a gas turbine engine having a static shroud in accordance with the invention, FIG. 2 is an enlarged cross-section taken in the axial direction through the static shroud of FIG. 1, FIG. 3 is a section on the line 3—3 of FIG. 2 but reduced in scale, FIG. 4 is a view on the arrow 4 of FIG. 2, FIG. 5 is a view similar to FIG. 3 but of a further embodiment and, FIG. 6 is a section on the line 6—6 of FIG. 5.

In FIG. 1 there is shown a gas turbine engine comprising a casing 10 within which are mounted in flow series the usual combination of compressor 11, combustion chamber 12 and turbine 13 and which forms at its downstream periphery a propulsion nozzle 14. Operation of the engine is broadly conventional and is therefore not described in this specification. However, it should be pointed out that although described as a separate entity this engine could easily comprise the core of a larger engine such as a fan engine.

The casing 10 is broken away in the region of the turbine 13 to expose to view the combustion chamber 15, the nozzle guide vane 16 and the first stage of turbine rotor blades 17 which are carried from a rotor disc 18. The blades 17 operate within an annular channel whose inner periphery is defined by platforms 19 carried from the blades themselves. The outer periphery of this passage is formed by an inner frustoconical surface 20 of a shroud ring 21.

The clearance between the surface 20 and the tips 22 of the blades 17 must be maintained at a very small value if the turbine is to operate efficiently. Thus it will be appreciated that any leakage of gas through this clearance represents a loss of energy to the turbine and a consequent loss of efficiency. Because the temperature of the rotor blades 17 is very high and their rotational speed under operating conditions is also very high there is considerable expansion and contraction of the tips 22 of the blades. In fact in some instances this growth may be of the order of 2–3 millimeters. It would of course be possible to arrange that the inner surface 20 of the shroud ring 21 was mounted sufficiently far away from the blade tips to allow the blades tips to grow by their maximum amount without contacting the surface 20. However, this would necessitate such a large clearance at cooler or slower running conditions as to produce an unacceptable penalty to the engine performance.

Therefore in the apparatus shown the ring 21 is caused to move axially so that the clearance between the frustoconical surface 20 and the angled blade tips 22 may be adjusted. To this end the ring 21 is provided in its outer surface 23 (see FIG. 2) with an elongated recess 24 in which a sliding block 25 locates an eccentric 26. The eccentric 26 is carried from a shaft 27 which passes through the casing 10 of the engine and at its outer extremity it is provided with a splined connection 28 which engages with a lever 29. As can best be seen from FIG. 4 the lever 29 is actuated via a spherical coupling 30 by the piston 31 of a ram 32.

As described so far the arrangement is similar to that of the previous Rolls-Royce Limited application Ser. No. 115,555 in which the cooled ring may be translated axially of the engine. However, in this embodiment three of the actuators comprising the rams 32 and the eccentrics 26 are provided and in line with each engagement between the eccentric 26 and its corresponding recesses 24 a sensor 33 is provided. As shown in FIG. 3 the sensor 33 is connected to a control unit 34 which controls a supply of pressurised fluid from a source 35 to the ram 32. The control system for each ram is therefore completely independent of the remaining two rams. It will be appreciated that if each control unit 34 is arranged to cause its respective ram 32 to move the eccentric 26 to provide a pre-determined small clearance at its respective sensor 33 the ring will be moved in a manner to compensate for any eccentricities between the rotor and the ring. Thus for instance taking the orientation depicted in FIG. 3 if the rotor 18 should drop with respect to the casing of the engine the clearance at the top will increase and at the bottom will decrease.

The sensor 33 at the topmost position will detect an increase in clearance and it will cause its ram 32 to move the ring 21 in a downstream direction so as to reduce this clearance again. At the same time the remaining two sensors will detect a decrease in clearance and they will cause the rams to move their portions of the ring upstream to increase the clearance. The overall effect is therefore to cause the top of the ring to move downstream and the bottom to move upstream thereby tilting the ring.

It will be noted that by using three separate rams in this way it is possible for each of the rams to operate completely independently of the remaining two without there being any fight between the three actuators. It would of course be possible ,o use a greater number of rams but in this case some provision would have to be made to co-ordinate operation of the rams and to prevent fight.

It will also be understood that although this system can cope very well with large scale deviations in the clearance such as those that are caused by eccentricities it is not possible for it to deal with smaller scale deviations such as might be caused by one or more of the blade tips 22 standing proud of the remainder.

In addition to the operating features described above which are central to the operation of the device there are a number of secondary features which should be noted. It is clearly desirable that hot gases should be prevented from leaking between the platform of the nozzle guide vanes 16 and the ring 21 because such a leakage could bypass the turbine blades 16 and provide a performance penalty in just the same way as would an excessive clearance between the blades 16 and the surface 20. To prevent this happening the ring 21 has an upstream projection 34 in the form of an annular flange and the outer surface of this flange is sealed through a piston ring seal 35 to a projection 36 from fixed structure of the engine. On its downstream face the ring 21 again has a cylindrical surface 37 formed on part of its structure and which is sealed by a piston ring seal 38 to a flange 39 which is connected to the casing 10. The seals 35 and 38 therefore preclude any leakage of hot gas round the back of the ring 21.

Although described as being part of the ring 21 the surface 20 is in this embodiment formed as a separate annular member which is hooked at 40 and 41 into the inner surface of the ring 21 itself. Disengagement is prevented by an annular plate 42 which is built to the ring and which has an annular projection 43 which bears on the separate portions 20 to hold the hooks 40 and 41 in engagement. Cooling air is provided to the shroud portions 20 through channels 44 and 45 in the ring 21.

It will be noted that because the eccentrics 26 operate independently they will move relative to one another in a circumferential sense. Clearly this movement must be allowed to take place otherwise the eccentrics would jam once they tried to move out of the unison. To allow this movement the eccentrics 26 act on the sliding block 25, which is capable of circumferential movement in the slot 24 but is fixed axially. In this way the axial motion of the eccentrics is applied to the ring, while the sliding of the blocks in their respective elongated recesses 24 is sufficient to allow the eccentrics freedom to be displaced circumferentially. In order to prevent circumferential movement of the complete ring a pin 47 from the external surface of the ring is shown as engaging a slot 48 (FIG. 3) formed in fixed structure of the engine.

It will be noted that in the embodiment described above the ring tilts about at centre which varies in accordance with the individual movements of the actuators. This may be undesirable and FIGS. 5 and 6 illustrate a construction in which the centre of the tilting is arranged to be on the axis of the engine. In this case a ring 51 similar to the ring 21 is mounted on a pair of horizontal pivots 52 from a gimbal ring 53. The ring 53 is in turn mounted in vertical pivots 54 from a sliding ring 55. The ring 55 has splines 56 engaging in grooves 57 in a casing 58.

Once again three separate actuators 59 are provided each having its own sensor 60 and control unit 61. In this case the actuators 59 are simply shown as rams which act in a direct axial direction on the ring 51. Operation of the sensors and actuators is similar to that of the previous embodiment but it will be seen that axial translation of the cooled ring 51 is allowed by sliding of the sliding ring 55 with respect to the casing 58. The tilting of the ring is separately allowed for by the gimbal arrangement. In this case therefore the movement of the ring is more controlled in that it must always tilt about the engine axis because of the constraint of the gimbal arrangement. However, this is clearly a more complex arrangement than the first embodiment.

In all the cases described above the sensors 33 and 60 comprise any one of a variety of different types known to those skilled in the art. Examples includes pneumatic, magnetic, optical and mechanical devices. Similarly the control units 34 and 61 could be pneumatic, hydraulic, hydromechanical or electronic.

It will also be appreciated that the constructions described above could be departed from in various ways; in particular the arrangement could be applied to other applications than the turbine shroud described above. Clearly the actuation mechanism could be similarly varied.

I claim:

1. A static shroud for a rotor comprising an axially movable and tiltable shroud ring having a frusto-conical inner surface arranged to co-operate with a peripheral portion of said rotor to define a small clearance therebetween, and a plurality of actuators operatively connected to move the ring axially to vary said clearance in a predetermined manner, said actuators also being operatively connected to tilt said shroud ring out of a radial plane when necessary so as to compensate for eccentricity between said rotor and said ring.

2. A static shroud for a rotor as claimed in claim 1 and in which said plurality of actuators are operatively connected to said shroud ring at discrete locations about the same and are independently operable and act directly on a portion of the ring, and including means by which each of said actuators is controlled in response to a value of said clearance at or adjacent that portion of the ring acted on by the respective actuator.

3. A static shroud for a rotor as claimed in claim 2 and in which each of said means is a sensor corresponding to each one of said actuators, each sensor being arranged to measure said clearance at or adjacent each of the portions of the ring operated upon by one of said actuators.

4. A static shroud for a rotor as claimed in claim 2 and in which there are three said actuators.

5. A static shroud for a rotor as claimed in claim 1 and in which each of said actuators comprises an eccentric which may be rotated about a radial axis to move said ring.

6. A static shroud for a rotor as claimed in claim 5 and comprising a lever attached to said eccentric and a ram connected to said lever, whereby each said eccentric is operated by a ram via a lever.

7. A static shroud for a rotor as claimed in claim 5 and in which there are slide blocks fixed axially but slideable circumferentially with respect to the ring, and through one of which each said eccentric operates on the ring.

8. A static shroud for a rotor as claimed in claim 7 and comprising an engagement between said ring and adjacent fixed structure arranged to prevent the ring from rotating bodily in a circumferential direction.

9. A static shroud for a rotor as claimed in claim 1 and in which there are two mounting rings forming a gimbals arrangement, and on which said shroud ring is mounted, the outer ring of the gimbals arrangement being axially slideable with respect to the rotor.

10. In a gas turbine engine having a casing, a shroud ring operatively supported from said casing, and a bladed rotor which defines with said shroud ring a frusto-conical clearance increasing in diameter in a downstream direction, the improvement comprising:

means permitting axial movement of said shroud ring relative to said casing and said rotor and further permitting tilting movement out of a radial plane through said rotor; and means operable when necessary during operation of said engine to move said shroud ring axially for varying said clearance and/or for tilting said shroud ring to compensate for eccentricities between said rotor and said shroud ring.

11. In a gas turbine engine as claimed in claim 10 in which said first means includes means to limit tilting movement of said shroud ring on an axis intersecting the axis of said engine.

12. In a gas turbine engine as claimed in any of claims 10 or 11 wherein said second means includes a plurality of actuators operatively connected to said shroud ring at discrete locations about the same, and means to independently and/or simultaneously operate said actuators.

13. In a gas turbine engine as claimed in claim 12 in which said means to independently and/or simultaneously operate said actuators includes a sensing means positioned adjacent each of said actuators where said actuators are operatively connected to said shroud ring, each of said sensing means operating one of said actuators in accordance with a particular clearance sensed.

* * * * *